United States Patent [19]

Ewig, Jr.

[11] 4,086,802

[45] May 2, 1978

[54] RIVET GUN

[75] Inventor: John F. Ewig, Jr., Worcester, Mass.

[73] Assignee: Parker Manufacturing Company, Worcester, Mass.

[21] Appl. No.: 763,284

[22] Filed: Jan. 28, 1977

[51] Int. Cl.[2] ..... B21J 15/34
[52] U.S. Cl. ..... 72/391; 72/453.17
[58] Field of Search ..... 72/391, 453.17

[56] References Cited

U.S. PATENT DOCUMENTS

| | | | |
|---|---|---|---|
| 2,526,956 | 10/1950 | Kugler | 72/391 |
| 3,082,898 | 3/1963 | Bosch | 72/391 |
| 3,309,911 | 3/1967 | Simmons | 72/453.17 |
| 3,713,321 | 1/1973 | LaPointe | 72/453.17 |

*Primary Examiner*—C.W. Lanham
*Assistant Examiner*—Gene P. Crosby
*Attorney, Agent, or Firm*—Norman S. Blodgett; Gerry A. Blodgett

[57] ABSTRACT

Rivet gun having an internal mandrel gripping chuck driven hydraulically by a coaxial piston actuated by a manually operated pump piston.

15 Claims, 3 Drawing Figures

RIVET GUN

BACKGROUND OF THE INVENTION

In making use of the so-called hollow, it is necessary to set the rivet by use of a rivet gun. While such rivet guns were originally purely mechanical in nature and operated by the use of the mechanical advantage obtained with a long pair of handles, the advantages of the use of hydraulic actuation has always appealed to the designers of such guns. The actual advantages of a hydraulic rivet gun have been difficult to obtain, however, because of the added complexity and cost of such guns, as well as the danger inherent in a hydraulic system. Careful design and improved manufacturing techniques have recently lowered the cost of a hydraulic rivet gun and have removed some of the inherent dangers. An example of a rivet gun of this type is shown in the patent of LaPointe U.S. Pat. No. 3,713,321 which issued Jan. 30, 1973. While the construction shown and described in that patent provides an adequate hydraulic rivet gun, it, nevertheless, suffers from some disabilities. The fact that the mandrel jaw and the hydraulic piston operate along spaced-parallel lines, for instance, can cause a binding force couple in the mechanism. It is also possible to pinch one's finger between the mandrel jaw and the rivet anvil at the nose. It is also difficult to operate if the rivet is located in a narrow recess. There is also the possibility of a user raising the hydraulic pressure to a dangerous level. These and other difficulties experienced with the prior art devices have been obviated by the present invention.

It is, therefore, an outstanding object of the invention to provide a rivet gun in which the moving mechanisms for pulling the mandrel of the rivet are located on the interior of the gun and cannot injure the user.

Another object of this invention is the provision of a rivet gun of the hydraulic type in which it is impossible to raise the hydraulic pressure to a dangerous level.

A further object of the present invention is the provision of a rivet gun having a very narrow operating nose that will permit access to a rivet located in a narrow recess.

It is another object of the instant invention to provide a rivet gun operated by a hydraulic piston in which all of the mandrel-drawing forces are in alignment, so that a binding force-couple does not exist.

A still further object of the invention is the provision of a rivet gun of the hydraulic type having a housing which can be manufactured inexpensively on conventional machine tools without the use of special castings.

It is a further object of the invention to provide a hydraulic rivet gun which is simple in construction, which is inexpensive to manufacture, and which is capable of a long life of useful service with a minimum of maintenance.

It is a further object of the invention to provide a hydraulic rivet gun which can be refilled by the user, since all hydraulic devices have some oil loss.

It is a further object of the invention to provide a hydraulic rivet gun which can be cleaned and repaired or grippers replaced with a minimum of effort.

With these and other objects in view, as will be apparent to those skilled in the art, the invention resides in the combination of parts set forth in the specification and covered by the claims appended hereto.

SUMMARY OF THE INVENTION

In general, the invention consists of a rivet gun for use with a hollow rivet having a mandrel. The gun is provided with a main body having a hand grip and an elongated barrel and with a squeeze lever which is pivotally attached to the main body adjacent the hand grip. A rivet anvil is mounted on one end of the barrel, the anvil having a mandrel-receiving bore which is concentric with an axis extending longitudinally of the barrel. A pump piston is carried in the handle and operable by the squeeze lever. A main piston is slidable in a bore in the barrel which is concentric with the said axis and the piston has a gripper cone attached thereto with a bore formed therein having a conical portion. A mandrel gripper jaw is movable in the said conical portion of the gripper cone bore and the gripper cone is connected to the said main piston for movement toward and away from the rivet anvil. A reservoir is formed in the barrel for the purpose of storing a body of hydraulic fluid and a check valve is located between the pump piston and the main piston.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
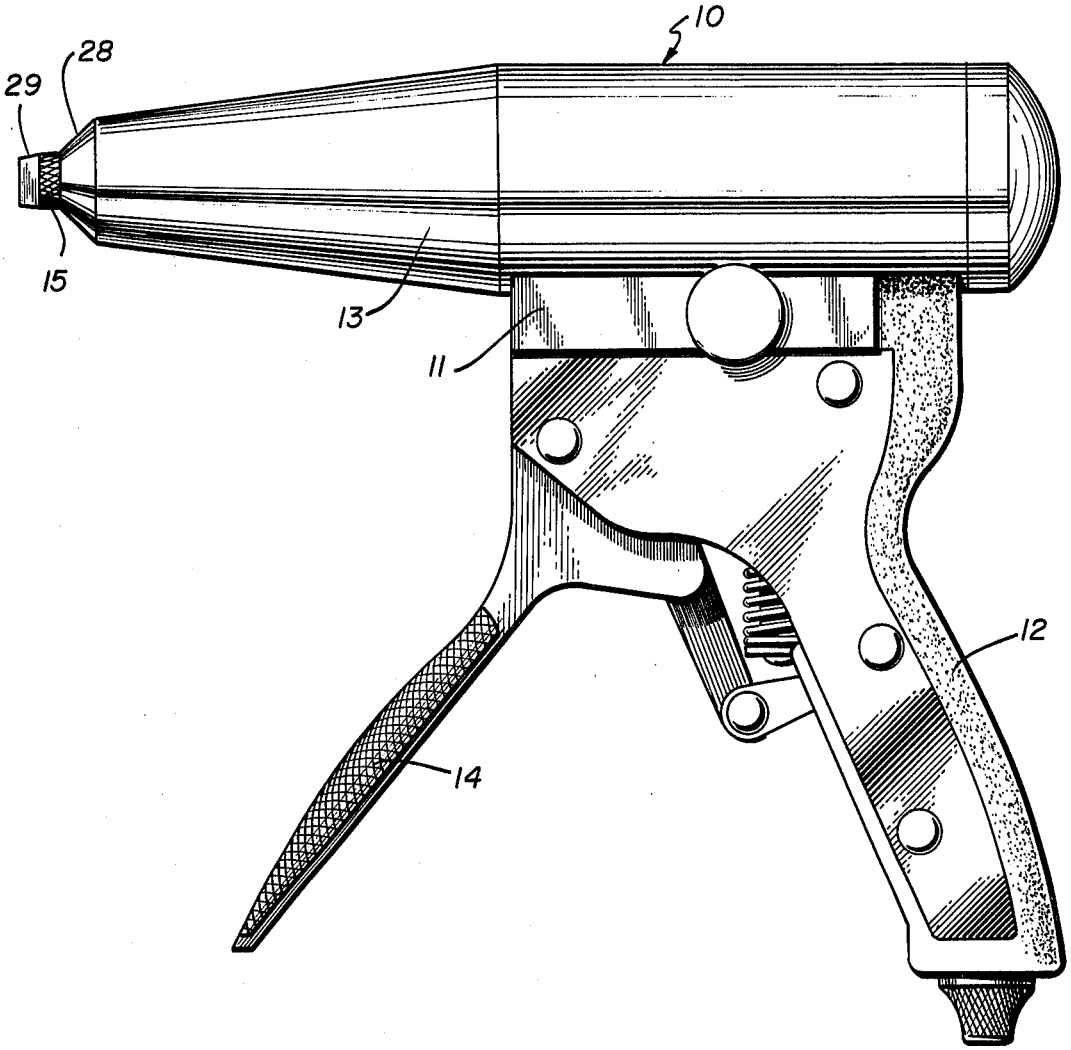
FIG. 1 is a front elevational view of a rivet gun embodying the principles of the present invention.
Figure 2:
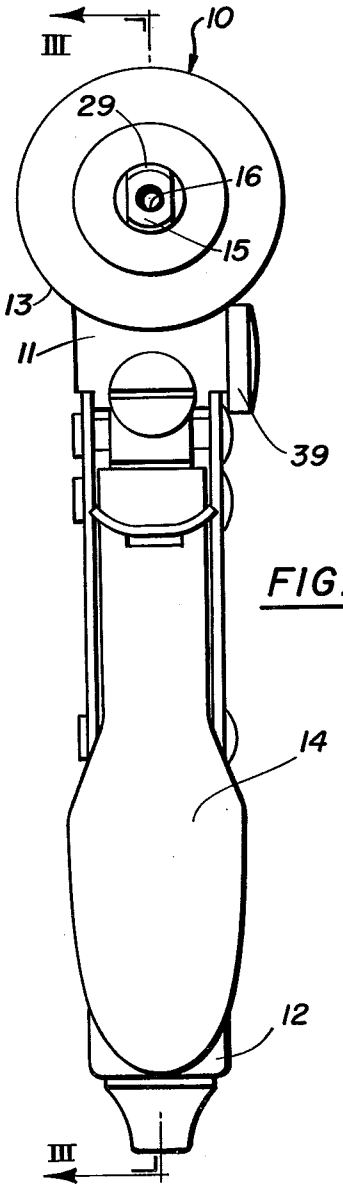
FIG. 2 is a left-hand end elevational view of the rivet gun.

Referring first to FIGS. 1 and 2, which best show the general features of the invention, the rivet gun, indicated generally by the reference numeral 10, is shown as being of the type intended for use in applying a hollow rivet having a mandrel to a workpiece. The gun is provided with a main body 11, having a hand grip 12 and an elongated barrel 13. A squeeze lever 14 is pivotally attached to the main body adjacent the hand grip. A rivet anvil 15 is mounted on one end of the barrel 13 and is provided with a mandrel-receiving bore 16 (see FIG. 2) which is concentric with an axis extending longitudinally of the barrel.

Figure 3:
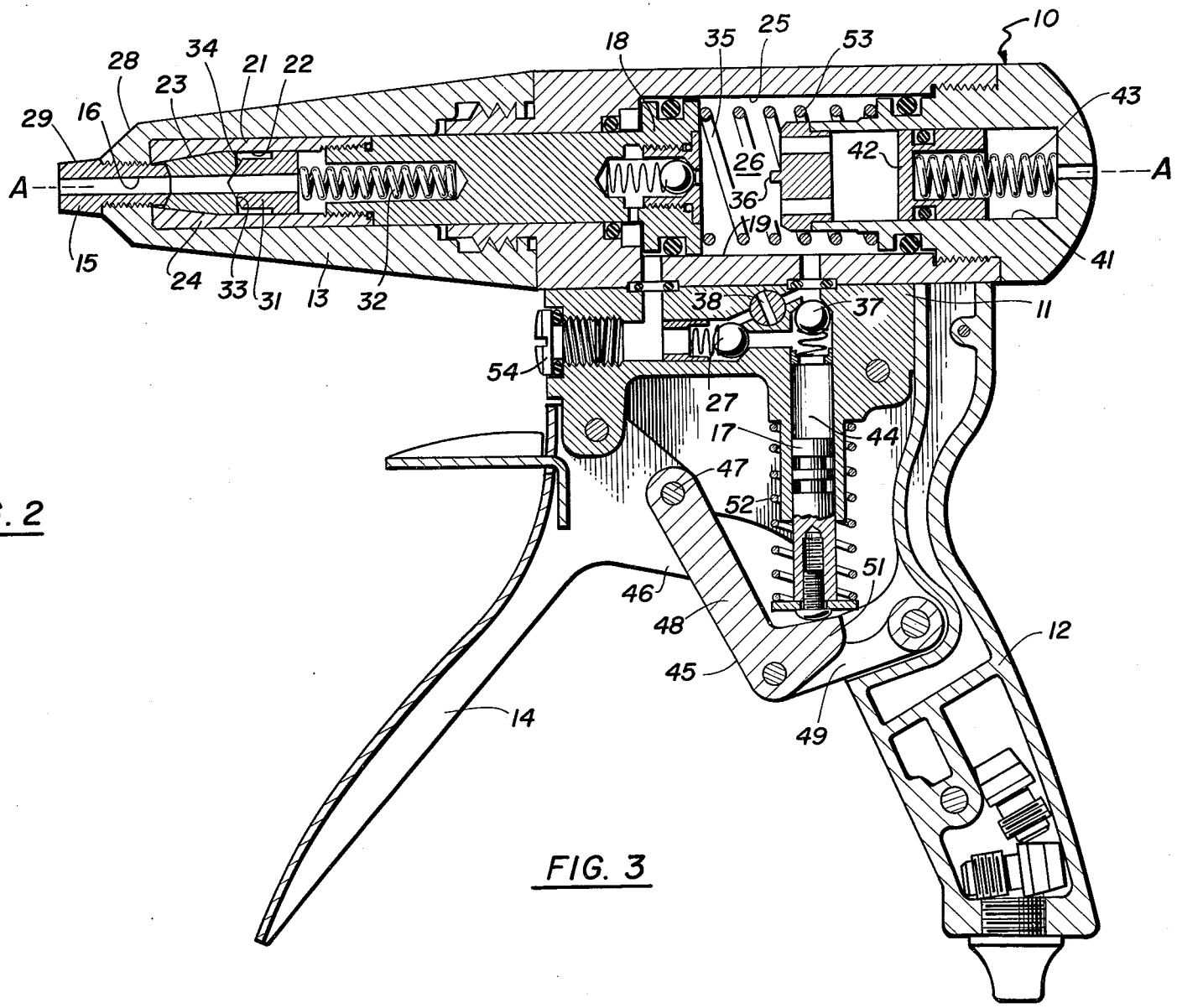
FIG. 3 is a vertical sectional view of the rivet gun taken on the line III—III of FIG. 2.

Referring next to FIG. 3, it can be seen that a pump piston 17 is carried in the hand grip 12 for movement at a right angle to the axis of the mandrel bore 16 and is operated by the squeeze lever 14. A main piston 18 is slidable in a bore 19 formed in the barrel concentric with the said axis of the mandrel bore. A gripper cone 21 is attached to the main piston and is formed with a bore 22 having a conical portion 23. Mandrel gripper jaws 24 are movable in the said conical portion of the bore for movement toward any away from the rivet anvil. A reservoir 25 carrying a body 26 of hydraulic fluid is formed in the barrel. A check valve 27 is located in a passage connecting the pump piston 17 to the main piston 18.

The barrel 13 is provided with a conical surface 28 at the anvil end which surface merges with a conical outer surface 29 on the rivet anvil 15. In other words, the small end of the conical surface of the barrel meets and is of the same diameter as the large end of the conical surface of the rivet anvil. A gripper cone bushing 31 is also slidable in the gripper cone bore 22 and a coil spring 32 lies under compression between the main piston and the said bushing. The gripper jaws are provided with a conical recess located at the end away from the anvil and this is engaged by a similarly-formed conical protuberance 34 formed on the adjacent end of the bushing 31. A safety release valve 35 is located in the main piston and a finger 36 is mounted in a fixed position relative to the barrel and is adapted to engage and release the valve at an extreme position of travel of the main piston.

The check valve 27 is arranged to allow fluid flow only from the pump piston 17 to the main piston 18. Another check valve 37 is connected to allow flow of fluid only from the reservoir 25 to the pump piston 17. A manually-operable valve 38 is mounted selectively to connect the pressure side of the main piston 18 to the reservoir 25. As is evident in FIGS. 1 and 2, the valve 38 is operated by a movable member 38 mounted externally of the main body in such a position that it can be pressed by the operator's thumb when his hand is wrapped around the hand-grip 12. The reservoir 25 is expandable and this function is accomplished by providing a bore 41 in which a piston 42 is slidably mounted. A coil spring 43 lies between one end of the bore and the piston to bias it toward the main piston 18. The pump piston 17 lies in a pump bore 44 extending at a right angle to the axis of the main piston 18 and the reservoir includes the bore 25 in which the main piston 18 is also slidable. The reservoir piston 42 and the main piston 18 are separated by a substantial space and an imaginary extension of the pump bore 44 passes through that space.

That particular space incorporates the check valve 27 which allows fluid flow only from the pump piston to the pressure side of the main piston. It includes the check valve 37 which allows the fluid flow only from the reservoir to the pump piston and it includes the manually-operated valve 38 which is adapted to connect the main piston to the reservoir. The squeeze lever 14 is connected to the pump piston 17 by a lever system 45. The squeezing of the lever 14 toward the hand-grip 12 causes a point in the lever system to move the pump piston vertically upwardly. The squeeze lever is provided with a protuberance 46 on the side facing the hand-grip. This protuberance has a pivot pin 47 which moves parallel to the axis of the pump bore 44 when the squeeze lever is moved toward the handle-grip. One end of a first link 48 is pivotally connected to the squeeze lever at the said pivot pin and one end of a second link 49 is pivotally connected to the handle grip. The other ends of the two links are pivotally connected. The first link is provided with an integral bell crank arm 51 that extends beyond the pivotal connection of the links and engages the pump piston 17. A coil spring 52 concentric with the pump piston is operative to bias the pump piston and the bell crank arm in the direction that moves the squeeze lever away from the hand grip. A large slotted bolt 54 is provided to allow the operator to bleed the system if this seems to be necessary.

The operation and advantages of the present invention will now be readily understood in view of the above description. The pop rivet is mounted on the rivet anvil 15 by passing the mandrel through the bore 16, so that it lies between the gripper jaws 33. The flange on the rivet portion rests against the front portion of the nose of the anvil 15. The operator holds the rivet gun in a manner similar to a shooting gun and inserts the rivet through the two elements that are to be fastened together. He then presses the squeeze lever 14 toward the grip handle 12 and through the lever system 45. A piston 17 is moved upwardly in the bore 44 and hydraulic fluid flows through the check valve 27 to the left-hand side of the main piston 18. The rivet, including its mandrel, starts to the right, but the slight movement of the mandrel causes the flange on the rivet to press tightly against the outer end of the nose of the anvil. The movement of the piston to the right causes the jaws 24 to grip the mandrel through the medium of the gripper cone 21, since its conical portion 23 engages a similar conical surface on the exterior of the gripper jaws 24. The mandrel, therefore, is moved to the right and this movement of the mandrel causes the head of the mandrel to collapse the free end of the hollow rivet on the other side of the workpiece elements which are to be fastened. Upon completion of a stroke of the piston, the operator allows the squeeze lever 14 to move back away from the handle-grip 12. The coil spring 52 carries the piston back down again. When it does this, suction is created in the bore 44 above the piston and this closes the ball valve 27, while at the same time causing the ball valve 37 to open against the pressure of its spring. This allows hydraulic fluid to travel from the reservoir 25 through the check valve 37 into the bore 44. Hydraulic fluid is, therefore, available for the next stroke of the piston 17.

The operator again squeezes the lever 14 toward the handle-grip 12, causing the piston 17 to move upwardly and to introduce a further amount of fluid into the bore at the left of the piston 18. Each time this cycle is repeated, the gripper jaws 24 are moved further away from the anvil 15. This causes the head on the mandrel to continue collapse the rivet to form a flange on the back side of the articles to be fastened together. Eventually, the flange is formed against the back surface of these articles in such a way that further operation of the gun no longer results in deformation of the rivet, but only serves to increase greatly the forces in the mandrel. Eventually, these forces reach an amount sufficient to break the mandrel in the customary way and the riveting operation is completed. The operator then moves the gun away from the completed rivet. He then presses the movable element on the outside of the gun and this releases fluid from the left side of the piston so that the main piston spring 53 presses the main piston back to its original position. This allows the broken piece of mandrel to drop out of the bore 16 in the rivet anvil. The fact that the piston 42 is spring-loaded by the spring 43 means that the size of the reservoir changes with the amount of fluid in the various parts of the system. If the operator attempts to exceed a predetermined pressure (in the preferred embodiment about 3,000 p.s.i.) in the chamber to the left of the piston 18, the piston operates against the spring 53 and, eventually, the ball in the safety release valve 35 is contacted by the finger 36. This moves the ball away from its seat against its spring and allows fluid to flow from the left-hand side to the right-hand side of the piston and relieve the excess pressure. It will be understood that this will simply relieve a slight amount of pressure that brings the piston back to a position slightly to the left of the point that the pressure was exceeded. Normally, the only time this would happen is the operator was pumping up the gun without a rivet in place. Since the movement that takes place in gripping the mandrel and pulling it is entirely inside of the barrel, there is no danger of the operator having his finger caught between the anvil 15 and the jaws 24. The provision of the conical surface 28 on the barrel and surface 29 on the rivet anvil makes it possible to introduce a rivet into an area that is quite restricted. The amount of pressure brought to bear on the rivet is completely under the control of the operator in accordance with the amount that he squeezes on the lever 14. By using long strokes to the lever, of course, he increases the flow of fluid and the pressure by large amounts. It is possible by making short strokes to increase the oil pressure in small increments. He would probably want to use short strokes the time that the mandrel is almost ready to break. Because of the tremendous forces available in this hydraulic system, it is possible to handle large rivets, even as large as 3/16 of an inch. Nevertheless, it is possible to release the hydraulic pressure built up at any time for safety purposes. The cap at the end of the barrel carries the bore 41 and can be threadedly removed from the rest of the barrel in order to add oil from time to time.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letter Patent is:

1. A rivet gun for use with a hollow rivet having a mandrel, comprising:

(a) a main body having a hand grip and an elongated barrel, (b) a squeeze lever pivotally attached to the main body adjacent the hand grip, (c) a rivet anvil mounted on one end of the barrel, the anvil having a mandrel-receiving bore concentric with an axis extending longitudinally of the barrel, (d) a pump piston carried in the handle and operable by the squeeze lever, (e) a main piston slidable in a bore in the barrel concentric with the said axis, and having a gripper cone attached thereto with a bore formed therein with a conical portion, (f) a mandrel gripper jaw movable in the said conical portion of the gripper cone bore for movement toward and away from the rivet anvil, (g) a reservoir formed in the barrel for retaining a body of hydraulic fluid, (h) a check valve between the pump piston and the main piston, and (i) a safety release valve located in the main piston and a finger is fixed relative to the barrel to engage and operate the release valve at an extreme positon of travel of the main piston.

2. A rivet gun as recited in claim 1, wherein a gripper cone bushing is also slidable in the said gripper cone bore, and wherein a spring operates between the main piston and the said bushing.

3. A rivet gun as recited in claim 1, wherein the check valve is arranged to allow fluid flow only from the pump piston to the main piston.

4. A rivet gun as recited in claim 1, wherein a check valve is connected to allow flow of fluid only from the reservoir to the pump piston.

5. A rivet gun as recited in claim 1, wherein the barrel is provided with a conical surface at the said one end, wherein the rivet anvil has a conical outer surface, and wherein the smaller end of the conical surface of the barrel meets and is of the same diameter as the large end of the conical surface of the rivet anvil.

6. A rivet gun as recited in claim 5, wherein the gripper jaw is provided with a conical recess that is engaged by a conical protuberance on the bushing.

7. A rivet gun as recited in claim 1, wherein a manually-operable valve is mounted selectively to connect the main piston to the reservoir.

8. A rivet gun as recited in claim 7, wherein the valve is operated by a movable member mounted externally of the main body in a position such that it can be pressed by the thumb when the hand is wrapped around the grip.

9. A rivet gun as recited in claim 1, wherein the reservoir is expandible.

10. A rivet gun as recited in claim 9, wherein the reservoir consists of a bore in which a reservoir piston is slidably mounted, and wherein a coil spring lies between one end of the bore and the piston.

11. A rivet gun as recited in claim 1, wherein the pump piston lies in a pump bore extending at a right angle to a main piston bore, and wherein the reservoir includes a bore aligned with the main piston bore.

12. A rivet gun as recited in claim 11, wherein the reservoir piston and the main piston are separated by a substantial space, and wherein an imaginary extension of the pump bore passes through the space.

13. A rivet gun as recited in claim 12, wherein the check valve is located in an area adjacent to the said space to allow fluid flow only from the pump piston to the main piston, wherein said area includes another check valve connected to allow the flow of fluid only from the reservoir to the pump piston, and wherein the said area includes a manually-operable valve to selectively connect the main piston to the reservoir.

14. A rivet gun as recited in claim 1, wherein the squeeze lever is connected to the pump piston by a lever system, wherein the squeezing of the lever toward the hand grip causes a point in the lever system to move the pump piston.

15. A rivet gun as recited in claim 14, wherein the squeeze lever is provided with a protuberance on the side facing the hand grip, the protuberance having a pivot pin which moves parallel to the axis of the pump bore when the squeeze lever is moved toward the handle grip, wherein one end of a first link is pivotally connected to the squeeze lever at the said pivot pin, wherein one end of a second link is pivotally connected to the handle grip, the other ends of the links being pivotally connected, the first link being formed with an integral bellcrank arm that extends beyond the pivotal connection of the links and engages the pump piston, and wherein a coil spring concentric with the pump piston is operative to bias the pump piston and the bellcrank arm in the direction to move the squeeze lever away from the hand grip.

* * * * *